United States Patent [19]

Zheng et al.

[11] Patent Number: 4,753,226

[45] Date of Patent: Jun. 28, 1988

[54] COMBINATION DEVICE FOR A COMPUTERIZED AND ENHANCED TYPE OF EXTERNAL COUNTERPULSATION AND EXTRA-THORACIC CARDIAC MASSAGE APPARATUS

[75] Inventors: Zhen-Sheng Zheng; Yutian Wu, both of Guangzhou, China

[73] Assignee: Biomedical Engineering Development Center of Sun Yat-Sen University of Medical Science, Guangzhou, China

[21] Appl. No.: 843,953

[22] Filed: Mar. 25, 1986

[30] Foreign Application Priority Data

| | | | |
|---|---|---|---|
| Apr. 1, 1985 | [CN] | China | 85200905 |
| Dec. 23, 1985 | [CN] | China | 85109285 |
| Mar. 3, 1986 | [CN] | China | 86101234 |

[51] Int. Cl.[4] ..... A61H 7/00

[52] U.S. Cl. ..... 128/64; 128/10; 128/20; 128/24.2; 128/54; 269/328

[58] Field of Search ..... 128/10 D, 20 D, 24 A, 128/24 R, 54, 64; 269/328

[56] References Cited

U.S. PATENT DOCUMENTS

| | | | |
|---|---|---|---|
| 2,345,073 | 3/1944 | Rosett | 137/625.11 |
| 3,277,887 | 10/1966 | Thomas | 128/54 |
| 3,403,673 | 10/1968 | MacLeod | 128/40 |
| 3,654,919 | 4/1972 | Birtwell | 128/64 |
| 3,659,593 | 5/1972 | Vail | 128/64 |
| 3,811,431 | 5/1974 | Apstein | 128/64 |
| 3,862,629 | 1/1975 | Rotta | 128/24 R |
| 3,865,102 | 2/1975 | Birtwell et al. | 128/64 |
| 3,866,604 | 2/1975 | Curless et al. | 128/64 |
| 3,878,839 | 4/1975 | Norton et al. | 128/64 |
| 4,091,804 | 5/1978 | Hasty | 128/24 R |
| 4,326,507 | 4/1982 | Barkalow | 128/54 |
| 4,375,217 | 3/1983 | Arkans | 128/24 R |
| 4,388,919 | 6/1983 | Benjamin, Jr. et al. | 128/64 |
| 4,397,306 | 8/1983 | Weisfeldt et al. | 128/28 |
| 4,421,109 | 12/1983 | Thornton | 128/25 R |

FOREIGN PATENT DOCUMENTS

| | | | |
|---|---|---|---|
| 1310492 | 1/1973 | United Kingdom | 128/24 R |
| 1426439 | 2/1976 | United Kingdom | 128/24 R |
| 498943 | 4/1976 | U.S.S.R. | 128/64 |

*Primary Examiner*—William E. Kamm
*Assistant Examiner*—Timothy Keegan
*Attorney, Agent, or Firm*—Pennie & Edmonds

[57] ABSTRACT

A combination device are provided for a microcomputerized and enhanced type of external counterpulsation and extrathoracic cardiac massage apparatus. In addition to balloons for the 4 limbs, the device also comprises a pair of lower-abdomen-buttock balloons and a chest balloon. It is controlled by microcomputer process. The various sets of balloons are sequentially inflated from the distal portion to the proximal portion during the diastolic period of the heart beat. The pressure is applied from the distal to the proximal portion gradually onto the 4 limbs, lower abdomen buttock and lower portion of the sternum. At the beginning of the cardiac systole all of the balloons deflate simultaneously. The cycle is then repeated. This device used for the treatment of diseases of the heart, the brain, the kidneys, the isohemic disease of the retina and the peripheral vascular disease with apparent curative effect. For those cases of sudden cardiac arrest, the computer gives orders according to need, so that the above-mentioned sets of balloons exert pressure sequentially from the distal portion to the proximal portion to force the blood to the adbomen, the chest and the head. Thereafter the device deflates suddenly, and then again the balloons sequentially inflate from the proximal portion to the distal portion to force blood back to the lower portion of the body. Thus the circulation goes on wave-like in succession to support adequate output as well as adequate cardiac blood inflow, and improves the effect of resuscitation.

8 Claims, 8 Drawing Sheets

FIG. 2a
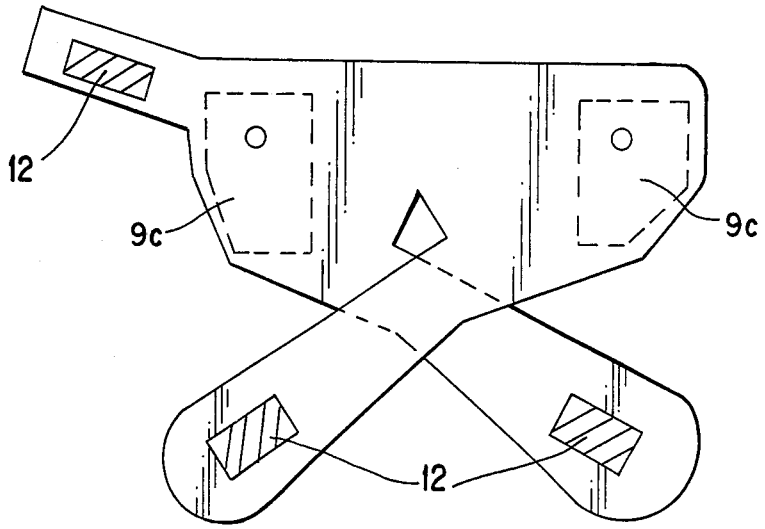
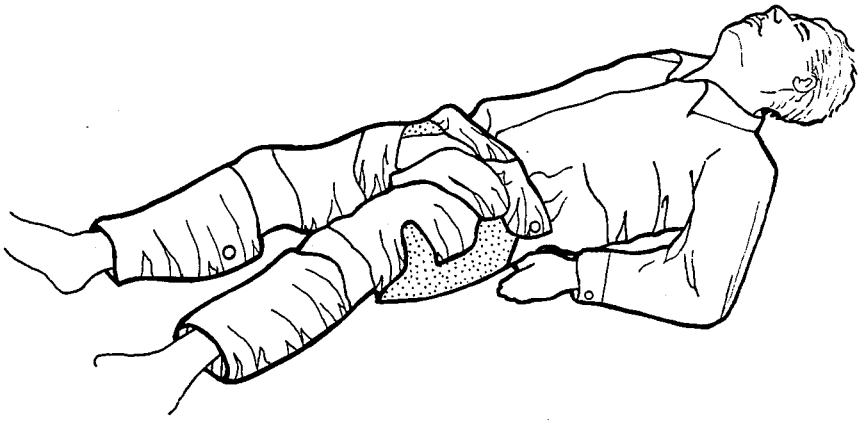
FIG. 2b

COMBINATION DEVICE FOR A COMPUTERIZED AND ENHANCED TYPE OF EXTERNAL COUNTERPULSATION AND EXTRA-THORACIC CARDIAC MASSAGE APPARATUS

FIELD OF THE INVENTION

The present invention relates to a new instrument for physical treatment. Virtually, it provides a newer type of combination device for a computerized and enhanced model of external counterpulsation and extrathoracic massage apparatus.

BACKGROUND OF THE INVENTION

In American Cardiovascular Journal (32 (10) 656–661, 1973) Dr. Cohen has reported a device for external counterpulsation, a four-limb sequential counterpulsation device. It consists of multiple balloons wrapped around the four limbs of the patient. The pressure is applied sequentially from the distal portion to the proximal portion of the four limbs. Using high pressure gas for its source of energy (1000 to 1750 mm Hg) and by controlling the time of opening of the solenoid valve, the balloons receive a fixed amount of air during inflation; and by using a vacuum pump the balloons deflate. The necessity of using a large air compressor vacuum pump set and pressure monitoring device is to insure that no excessive pressure is exerted in the balloons. However, the device is bulky, causes loud noises is complicated to operate, and expensive. It is, therefore, unsuitable for clinical use.

The inventor of the above mentioned device, however has introduced and adopted another device of sequential counterpulsation on the four limbs without the source energy from high-pressure gas and the vacuum pump. The device makes use of a low-pressure large-flow pump to supply oil-free gas. In this way the size of the apparatus is decreased and the noise is reduced to below 62 db. Owing to the adoption of a larger channel and fixed time of inflation (100 m sec.) and keeping the pressure in the gas reservoir at 270 to 300 mm Hg, the pressure in the balloons is constant. There is no need to install a pressure monitoring system, and so the operation is relatively simple. The diastolic pressure is augmented by 32%. Ear-pulse waves have shown that the ratio of diastolic wave amplitude to that of systolic wave amplitude (D/S) is equal to $1.32 \pm 0.19$. The clinical and experimental data have shown that in order to get better counterpulsation effect and to promote the establishment of collateral circulation it is necessary to raise the diastolic pressure to a certain level.

In that device of counterpulsation the augmentation of diastolic pressure is not conspicuous enough. Besides, the ECG analogue filter, the R wave detector and the R—R integrator of the inflation-deflation processing device are all of the analogue circuit. Therefore, the control of inflation-deflation timing is less accurate and their range is small. The device has no automatic delay control function, is large and bulky, and emits excessive noises. The bed for counter-pulsation is flat and therefore uncomfortable for the patient. The clinical results are not satisfactory.

Besides, the extrathoracic cardiac massage apparatus in current use is one that is placed at the lower portion of the sternum. The massage head is periodically lowered down and presses over the sternum so that pressure is exerted over the heart and the great vessel underneath, thus drives the blood to the periphery to achieve resuscitation. Yet, this method cannot expel an adequate amount of blood from the heart and the big vessels in the left chest. The amount of blood expelled is limited and cannot meet the physiological requirements. When the chest receives pressure the venous blood is expelled from the chest cavity. Due to the relaxation of the peripheral vessels, a great amount of blood is stored in the blood vessels, which in turn causes brain anoxia. Besides, the brain anoxia and the relaxation of the peripheral vessels, a great amount of blood is stored in the blood vessels so that the return of venous blood to the heart is decreased, central venous pressure is low, cardiac output diminishes, the arterial perfusion to the brain is low and is even lower to the cardiac muscles. Through years of clinical practice this method has proved that it offers less chance of resuscitation.

DISCLOSURE OF THE INVENTION

Accordingly, it is a primary object of the present invention to provide a combination device for external counterpulsation and extrathoracic cardiac massage apparatus. Its purpose is to augment the diastolic pressure of the aorta and cardiac output, to improve anoxemia and thus to effect the counterpulsation and resuscitation more efficiently.

Another object of the present invention is to provide a control system of the combination device for external counterpulsation and extrathoracic cardiac massage, which has the ability to select the proper time of inflation and deflation in relation to the exact time of the pulsation. This will improve precision of control of the timing of inflation and deflation.

Still another object of the present invention is to provide a combination device of external counter-pulsation and extrathoracic cardiac massage, the volume of which is small, with well muffled noise, and easy to operate for clinical use.

A further object of the present invention is to provide a special bed for treatment with the combination device for external counterpulsation and extrathoracic massage. This bed is more comfortable for the patient, facilitates the proper placement of the massage apparatus, and enables better treatment.

Additional objects, advantages, and other novel features of the invention will be set forth in part in the description that follows and in part will become apparent to those skilled in the art upon examination of the following or may be learned with the practice of the invention.

To achieve the foregoing and other objects, the invention includes a counterpulsation bed, ECG amplifier, pulse wave amplifier which may respond to a pulse wave received from the ear or finger, monitor, sequential control circuit, and four sets of balloons including leg balloons and/or upper limb balloons, thigh balloons, lower abdomen-buttock balloons, and a chest balloon housed in an extrathoracic cardiac massage apparatus for acting upon the human thorax. These sets of balloons each connect by suitable tubing with a set of inflation/deflation solenoid valves installed in a gas distribution box. The inflation/deflation solenoid valve sets connect with a gas pump and gas reservoir, similarly through suitable piping. The invention also includes a microcomputer for synchronized calculation and control. The microcomputer comprises a CPU, EPROM, RAM, CTC, PIO, ADC, DAC, and counter which connect with the ECG amplifier and pulse wave amplifier. These components follow the ECG signal to provide inflation/deflation sequential control signals for control of the performance of the inflation/deflation solenoid valve sets. The microcomputer controls the operating mode of the monitor and executes the selection of a signal combination display mode and a dynamic or static display. Thus, through the ECG signal of the patient, under control of the microcomputer, the solenoid valve sets may be triggered to inflate during heart diastole. Inflation is in four sequential steps following decreasing pressure in the leg balloons and the upper limb balloons, thigh balloons, lower abdomen-buttock balloons and chest balloon. In this way a large amount of blood is driven back to the aorta. In connection with the return of the blood, pressure is applied by the extrathoracic massage instrument so that the amount of blood reaching the brain, the heart, the kidneys and the liver is adequate to maintain physiological requirements. This will improve the effect of counterpulsation and resuscitation. While in systole, all the parts exerting pressure are quickly relieved. Owing to the decrease in intravascular pressure, the systolic pressure is lowered, thus the resistance is lowered when the heart contracts, (after load) and the oxygen consumption of the heart is thus diminished.

In addition, a counterpulsation bed is provided, which is especially suited to the combination device for external counterpulsation and extrathoracic cardiac massage apparatus for clinical use. The bed is designed in accordance with the physiological curvature of the body with respect to its concave and convex surface. The ends of the bed can be raised and lowered. There are noise muffling hoods over and beneath the bed. The cardiac massage device is placed in a fixed position. Thus, the bed is insulated from the noise to leave the patient in a comfortable state while improving the efficiency of the treatment.

In a further aspect of the invention, in accordance with its objects and purposes, a method is applied through the use of the combination device for external counterpulsation and extrathoracic cardiac massage on sudden-cardiac-arrest patients and on those patients with organ anoxia while the heart is still pumping.

For the sudden-cardiac-arrest patient, the device under the control of a microcomputer, sends out a pulse signal with a frequency of 30 to 80 times per minute. Each pulse signal indicates a pressurized cycle, each of which triggers a mechanical system, which again, when the heart is in diastole, sequentially in four steps applies a decreasing pressure grading from the distal to the proximal portions on the balloons wrapped around the legs, the thighs, the lower-abdomen-buttock and the chest. This will force the blood to the body to supply to the main organs, as the brain, the heart, the kidneys, the lungs and the liver, etc., and to maintain effective and near-physiological-state blood circulation. While in systole all the balloons deflate simultaneously. Thereafter the balloons over the chest and the lower abdomen-buttocks are sequentially inflated to drive blood to the lower parts of the body for the use of the next pressurized cycle.

For those patients recovering from cardiac resuscitation, yet with a lower return blood wave during the diastolic phase of the heart beat, and also for those patients with organ ischemia, the combination device under the control of the microcomputer will improve their blood supply and promote the establishment of collateral circulation. The computer will first detect QRS waves as a signal to trigger the solenoid valve set which, during cardiac diastole, will sequentially inflate with pressure grading the balloons wrapped around the legs, the thighs, the lower abdomen-buttock and the chest. This will drive a large amount of blood to the aorta and produce another set of "pulse" to perfuse the organs, such as the brain, the coronary arteries, the kidneys, the lungs, etc. All the balloons, in the next cycle of the cardiac systole, will deflate rapidly, so as to lower intravascular pressure, to lessen the after load, and to decrease the oxygen consumption of the heart.

A preferred embodiment of this invention will now be shown and described. The following description is, simply by way of illustration of one of the modes best suited to carry out the invention. The several details of the invention are capable of modification in various, obvious aspects all without departing from the invention. Accordingly, the drawing and description will be regarded as illustrative in nature and not as restrictive.

A BRIEF DESCRIPTION OF ACCOMPANYING DRAWINGS

FIG. 1 is a systematic schematic diagram of the present invention of a combination device for external counterpulsation and extrathoracic cardiac massage apparatus with a chest balloon in it.

FIG. 2*a* is a diagram of the structure of lower abdomen-buttock balloons.

FIG. 2*b* is a diagram of the lower abdomen-buttock balloons applied to the body of the patient.

FIG. 3*a* is a diagram of the structure of the extrathoracic cardiac massage apparatus made of hard material having a chest balloon and equipped with a massage head.

FIG. 3*b* is a diagram of the structure of the extrathoracic cardiac massage apparatus made of soft material having a chest balloon and equipped with a massage head.

FIG. 3*c* is a diagram of the structure of the extrathoracic cardiac massage apparatus made of soft material having a chest balloon without a massage head.

A preferred embodiment of the present invention will now be illustrated in detail following the accompanying drawings.

Figure 1:
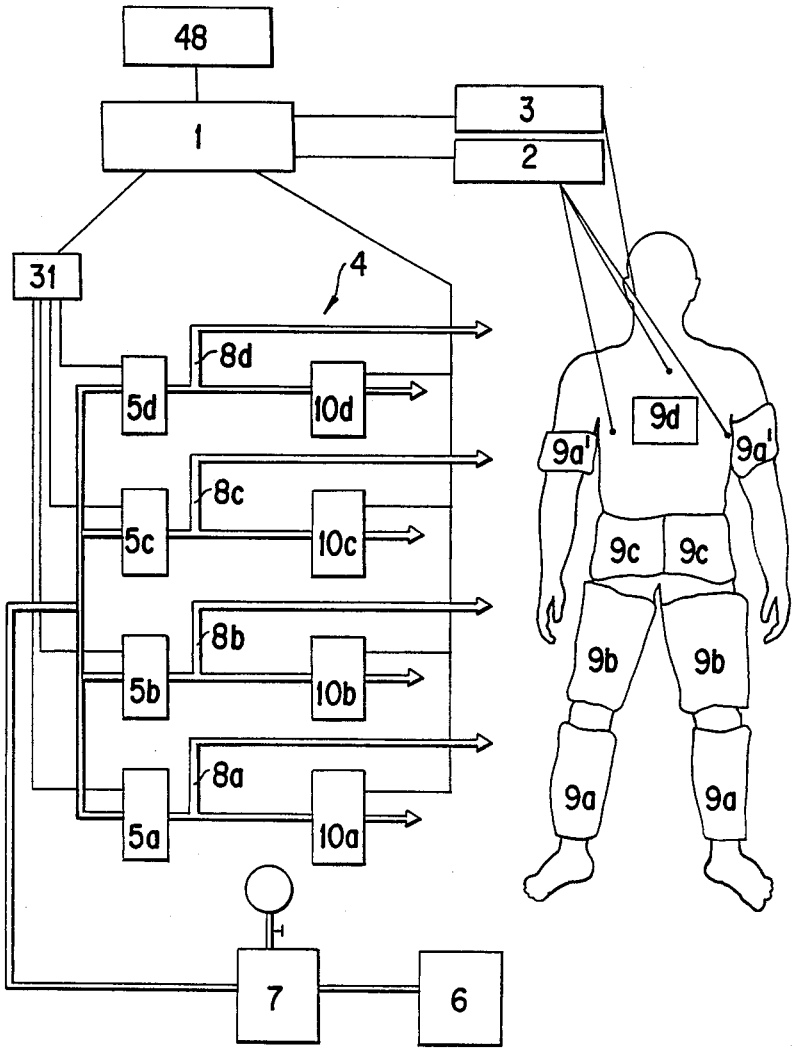

Reference is now made to FIG. 1, when the combination device is used for counterpulsating a patient with organ ischemia, as shown the signal of R wave of ECG or pulse wave, such as an ear pulse wave through ECG amplifier (2) or pulse wave amplifier (3), passing through the single board computer (1) with preset program of automatic control time delay. The signal then passes through power amplifier (31) to trigger opening sequentially 4 inflation solenoid valves (5*a*) (5*b*) (5*c*) (5*d*), in the gas distribution box. As a result positive pressure gas in gas reservoir (7) is connected from gas pump (6), in a fixed time, is passed respectively through inflation solenoid valves (5*a*), (5*b*), (5*c*), (5*d*) in the gas distribution box, and pipes (9a), (9b), (9c), (9d) and then entering into and inflating sequentially and respectively each set of balloons wrapped around the body of the patient from distal to proximal portions. These sets of balloons are leg balloons (9a) and upper-limb balloons (9a'), thigh balloons (9b), lower abdomen-buttock balloons (9c) as well as chest balloon (9d). Except for the chest balloon (9d), each set of the other 4 sets of balloons is composed of symmetrically placed double balloons on both sides of the limbs and buttocks. The inflated balloons exert pressure on the respective parts of the body, yet with a decreasing pressure grading from distal to proximal parts, so that the blood in the 4 limbs and buttocks is driven back to the chest, and thence to the trunk and the head. After the completion of inflation, in accordance with a preset program of controlled deflation time in the single board-computer by the operator, and before the occurrence of the next R wave from ECG amplifier (2), the 4 deflation solenoid valves (10a), (10b), (10c), (10d) in the gas distribution box (4) are simultaneously opened to render deflation of all balloons that exert pressure on the body. These balloons are the leg balloons (9a) and the upper-limb balloons (9a') the thigh balloon (9b) the buttock balloons (9c) and the chest balloon (9d). After the completion of deflation, blood is driven to the lower limbs until the next cardiac cycle, the same sequence of events is repeated. The gas pump (6) through gas reservoir (7) and the connecting pipes supplies positive pressure gas to gas distribution box (4). The gas pump (6) is a greaseless membrane type of low-pressure, large-flow. The single board computer (1) is connected to the display unit (40) for displaying ECG or pulse wave.

The combination device can be used in treating a patient with cardiac arrest without the use of ECG or ear pulse wave. In their stead, the computer, according to the selected preset constant (20) dispatches pulsed signals with a frequency of 30 to 80 times per minute. After the completion of the above mentioned program of inflation-deflation balloons, then the power amplifier (31) triggers the sequential opening of inflation solenoid valves (5d) and (5c) in the gas distribution box (4). The positive pressure gas in the gas reservoir (7) enters the chest balloon (9d) and the lower abdomen buttock balloons (9c) to exert pressure on the respective parts and to drive blood to lower limbs more effectively. Following the completion of inflation, the deflation valves open simultaneously, thus gas in chest balloon (9d) and lower abdomen-buttock is expelled to the atmosphere. After the completion of deflation, another pulsed signal appears, and the same program is repeated.

FIG. 2a shows a pair of lower abdomen-buttock balloons (9c) symmetrically placed on the right and left sides, inserted into the interleaves of a cuff (12) tailored to the profile of the buttock and being able to be wrapped tightly. Each balloon when lying flat has a surface area of greater than 300 $cm^2$, and an internal pressure of 160 to 250 mmHg, lower than that in the leg balloons (9a) and the thigh balloons (9b). As shown in FIG. 2b, the cuff (12) is wrapped onto and fixed to the buttocks by nylon fasteners.

Figure 3A:
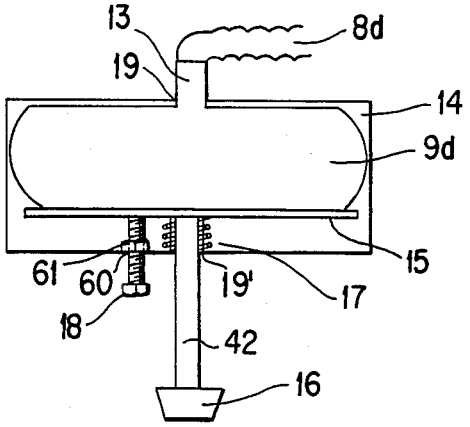
Figure 3B:
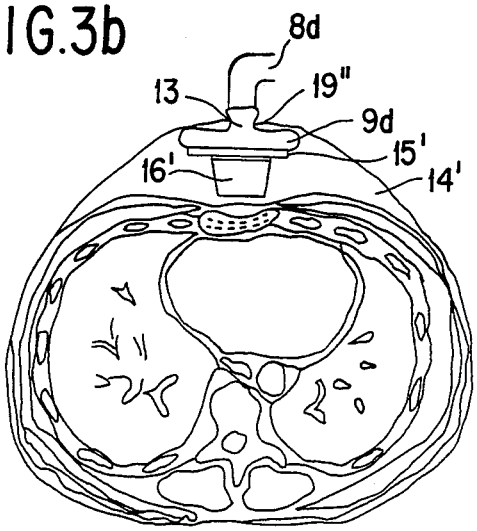
Figure 3C:
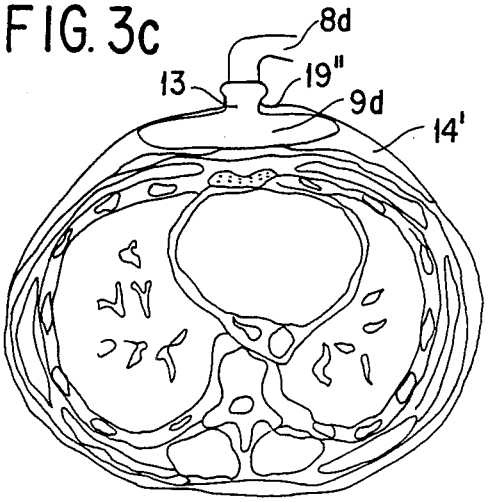

An important part of the present invention, in addition to the limb balloons, is that the apparatus also includes a chest balloon located within the extrathoracic cardiac massage apparatus of hard and/or soft material, with the massage head or wall of soft massage apparatus exerting directly pressure upon the lower end of the sternum. FIGS. 3a, 3b and 3c illustrate structure diagrams of a hard extrathoracic cardiac massage apparatus housing the chest balloon and a massage head, and a soft extrathoracic cardiac massage apparatus housing the chest balloon but without the massage head. Particularly, FIG. 3a represents the structure of a hard extrathoracic cardiac massage apparatus with a massage head, whose casing is of either a cubic or circular box (14) in which the chest balloon (9d) with its channel (13) is located. The top and bottom of the box, is respectively provided with a central hole (19) - (19'). The gas from the chest balloon passes through the top hole (19) to the pipes (8D) so that the chest balloons connect with the inflation-deflation solenoid valves (5d) and (10d). Located closely underneath the chest balloon (9d) is a pusher plate (15), the center of the plate bottom is fixed to a rod (42) which passes through the hole (19') in the bottom of the box. The other end of the rod is fixed to a massage head. A spring (17) is attached to the one end of rod (42) connected to pusher plate (15), with the two ends being closely connected with the lower surface of pusher plate (15) and the inner wall of the bottom of the hard massage apparatus. A small hole (60) exist near the central hole of the bottom of the hard massage apparatus. A nut (61) with its inside diameter agreeing with the diameter of the small hole is fixed at the lower inner wall of the bottom of the massage apparatus, and the end of a regulating screw (18) matching the nut penetrates the small hole (60) and the diameter of the nut (61) to be located on the lower side of the pusher plate (15). The lowering range of the massage head (16) can be adjusted by regulating the distance between the end of the regulating screw (18) and the lower side of pusher plate (15). In static condition, both the pusher plate (15) and the massage head (16) are pushed upward by a spring (17), so as to empty the chest balloon (9d). During inflation-distention of the chest balloon (9d), the pusher plate (15) moves downward by pressure, and thus the massage head (16) moves downward too, to press tightly onto the lower end of the sternum. The moving distance between the two is 2.5 to 5 cm. The pressure exerted is 35 to 50 Kg. By adjusting the regulating screw, the moving distance as well as the pressure can be controlled. During deflation of the chest balloon (9d) both the pusher plate (15) and the massage head (16) return to their original position by means of the recoil of spring (17). The chest balloon (9d), when lying flat, has a surface area of 100 to 150 cm on one side, and the pressure after inflation is 0.35 to 0.50 Kg/cm.

FIGS. 3b and 3c both show a soft massage apparatus which can be wrapped and fixed around the chest. The apparatus is provided with a ring-shape cuff (14') to enable it to be wrapped around the chest. Cuff (14') is made of leather, leatheret or woven fabric and being able to be fastened together by a nylon fastener. Inserted in the cuff (14') is a chest balloon (9d) while the channel (13) of the balloon passes through a hole (19'') in the cuff and is connected with the pipes (8d) coming from the inflation-deflation solenoid valves (5d) and (10d) which are connected to the chest balloon too. In FIG. 3b, underneath the chest balloon (9d) is a pusher plate (15'), the bottom of which is connected to a cardiac massage head (16'). Both are wrapped together in the cuff (14'). When in use, the massage head (16') is placed to the lower part of the sternum. While in FIG. 3c, only the chest balloon (9d) is in the cuff (14') without the pusher plate and massage head. When in use, the chest balloon (9d) as well as the cuff (14') is tightly applied to the lower part of the sternum.

Figure 4:
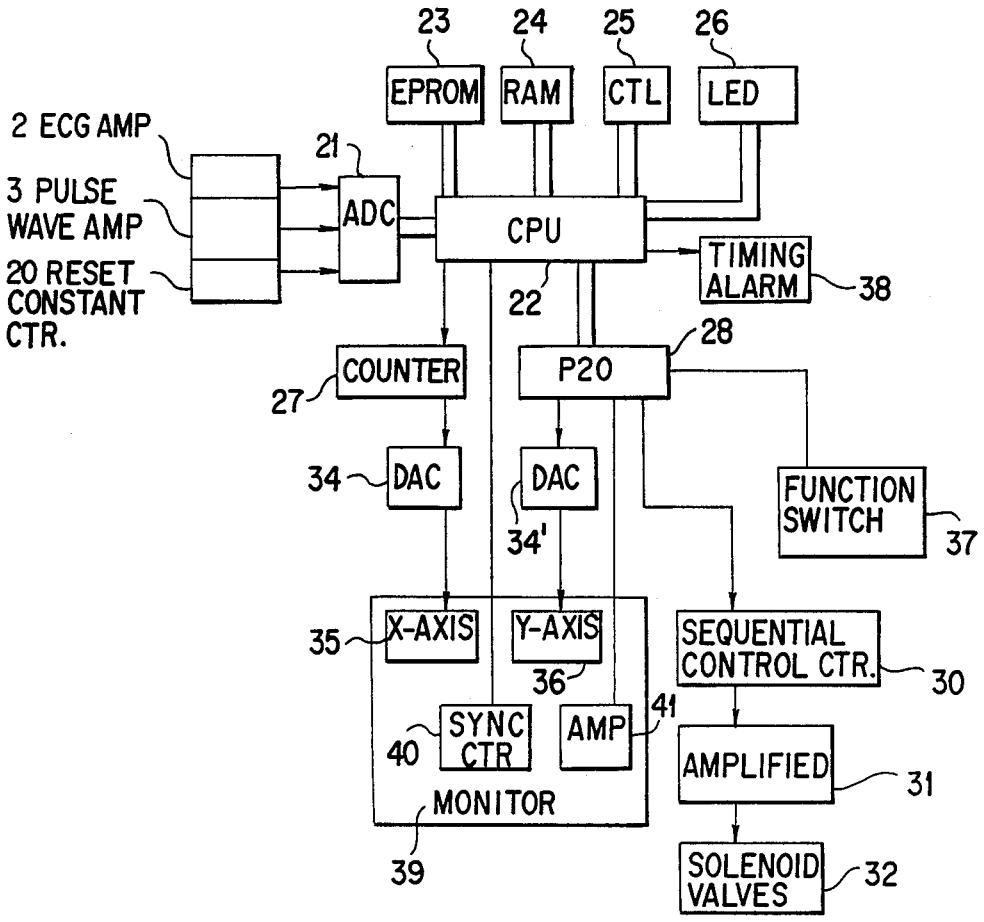
FIG. 4 is a schematic electric circuit diagram for the combination device.

Reference is now made to the schematic diagram of the structure of the combination device as shown in FIG. 4. The complete circuit includes CPU (22) and ADC (21), and EPROM (23), RAM (24), CTC (25) LED (26), counter (27), PIO (28), monitor (39), timing alarm (38) connected to the CPU. The ADC (21) connects, respectively, with ECG amplifier (2), pulse wave amplifier (3), and preset constant circuit (20); the counter (27) connects through DAC (34) with the X axis deflection system (35); PIO (28) connects, respectively, through DAC (34') with the Y axis deflection system (36) of the monitor (39) and through the sequential control circuit (30) and power amplifier (31) with the solenoid valve set (32), and also connects with the function switch (37); and the monitor (39) includes, in addition to the X axis deflection system (35) and Y axis deflection system (36), synchronous circuit (40) and blanking signal amplification circuit (41). During counterpulsation, the ECG wave through its amplifier (2), pulse wave through its amplifier (3) or a preset constant (20) present constant circuit entering into the main electric circuit, pass through ADC (21) to be digital signals sent into CPU (22). The ECG amplifier (2) is composed of a two-level amplifier with amplification factor of 500, 1000 and 2000, to yield voltage-level signal to ADC (21), CPU (22), EPROM (23), RAM (24), CTC (25), LED (26), counter (27), PIO (28), DAC (34), (34') in the microcomputer, and through A/D translation, to filter and detect QRS wave groups, making a timed computerization and display. In order to insure that the electric circuit has a common mode rejection ratio above 90 db, it makes use of a preamplifier comprising of three operational amplifiers, one of which is a main amplifier, the pulse wave while the other two are followers. Amplifier (3) is a two-level amplifier comprising of two operational amplifiers, with an amplification factor of 500, 1000 and 2000, and amplifying the signals received by light sensitive diode to voltage level, which (the signal) through processing by the main electric circuit is ready for display. ECG amplifier (2) and pulse-wave amplifier, each of which has an emitter follower to match the main electric circuit, limiting the output signal to below 5 volts, thus protecting ADC (21).

Inputs to CPU (22) are provided by CTC (25), the storage instruction in EPROM (23), the digital filtering of the ECG or pulse wave input digital signals into RAM (23), to CPU (22) in turn provides detect QRS wave groups from the ECG. The following formulae enables the calculation of the timing constants:

$$T_1 = \begin{cases} 1/4\ T_r - C_1' + C_1 & (300\text{ ms} \leqq T < 850\text{ ms}) \quad (1) \\ 1/5.2\ Tr - C_1'' + C_1 & (850\text{ ms} \leqq T < 1250\text{ ms}) \quad (2) \end{cases}$$

$$T_2 = Tr - T_1 - C_2$$

where, $T_1$-time of beginning of inflation derived from CPC (22)

$T_2$-time of beginning of deflation

Tr-R-R period of ECG $C_1'$, $C_1''$-in set constant of inflation $C_1$-out set constant of inflation $C_2$-out set constant of deflation Inflation time $T_1$ is the time interval between R wave to the time of the beginning of inflation. Deflation time $T_2$ is the time interval between $T_1$ and the time of the beginning of deflation. $C_1$ and $C_2$ in the formulae are formed by preset constant in subroutine, and $C_1$ is related to factors as the time-delay control (due to electric or mechanical factors and the patient's individual variation). To keep the inflation time at an optimun, the system can automatically follow the variations of the pulse rate and thus adjust the time when to begin the inflation.

It needs only to adjust $C_1$ to augment the diastolic pressure to a suitable level. $C_2$ is the time interval between the time of deflation and the next R wave.

The above formula (1) is derived and simplified from the empirical formula $T_1 = 0.4\sqrt{Tr} + C_1$ (tracing error less than 10 ms).

Figure 5:
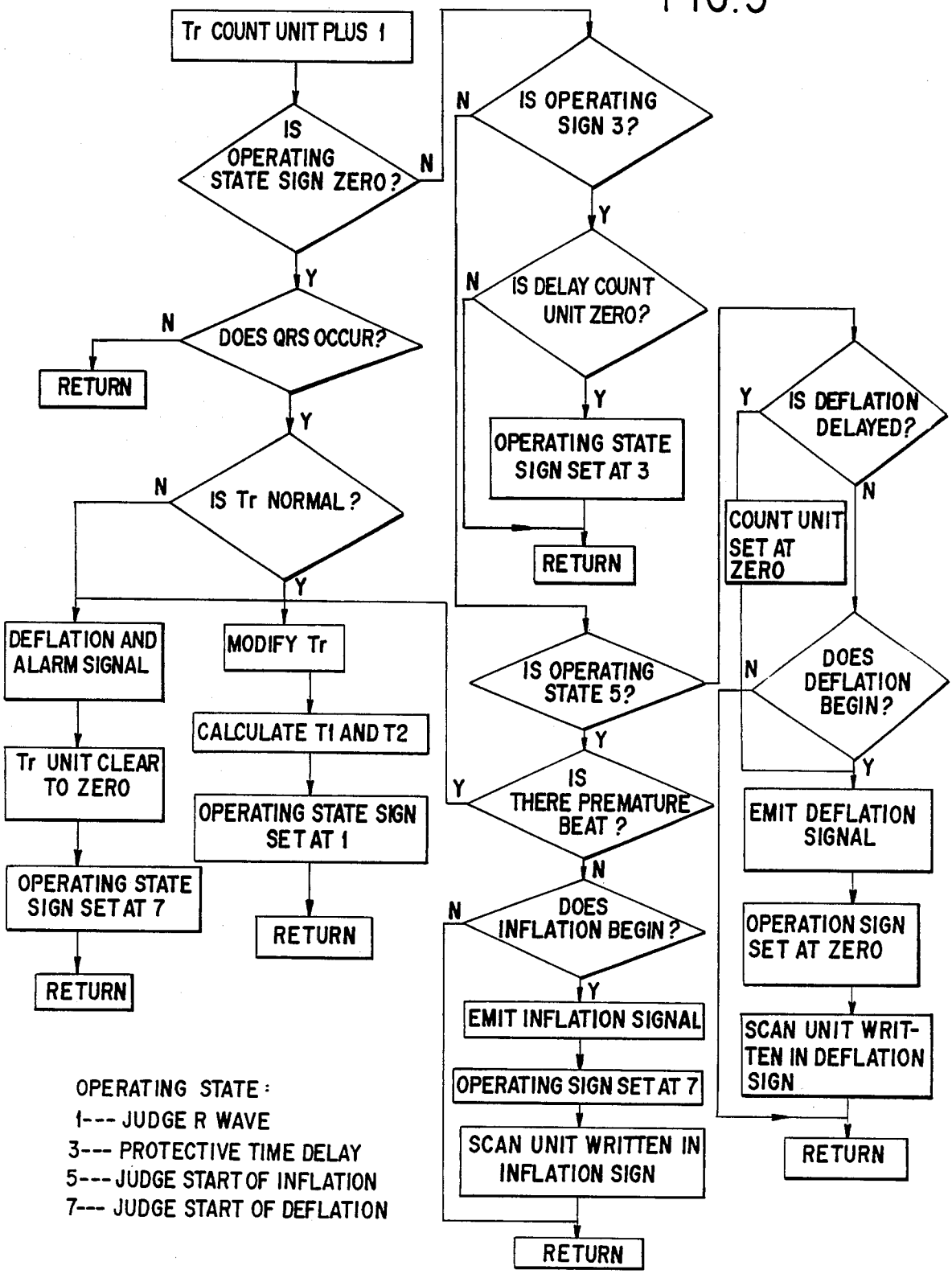
FIG. 5 shows a software block diagram for a timing calculation.

In order to trace R-R period (Tr) variation accurately and to diminish the influence of random factors, first the average value $\overline{Tr}$ of Tr is obtained by adding two Tr and dividing by 2. Then, to next normal Tr (those whose deviation from mean is less than 120 ms), and according to the formula $(\overline{Tr}+Tr)/2$, rectify $\overline{Tr}$ that was last time. FIG. 5 is the software block diagram of a timing calculation.

After deriving the time ($T_1$) for the beginning of inflation and the time ($T_1$) for the beginning of deflation, a control signal for the beginning of inflation and deflation to the inflation-deflation processing device to drive solenoid-valve sets (32), and thus to control inflation and deflation of the balloons is obtained from port PIO (28). The sequential processing device consist of a sequential control circuit (30), of which the 8D trigger is the main component, and a power amplifier (31) at each level of the electric circuit. The pulse rate and the time of the beginning of inflation and deflation, as computed by CPU (22) are sent to two sets of LED (26) of 3 digits for displaying. CPU (22) controls counter (27) and through DAC (34) produces X-axis-scan serrated wave, which is then sent to X axis deflection system (35) of the monitor. CPU (22) fetches the signal from RAM (24) and through B port of PIO (20), the signal is sent to another DAC (34) forming the Y axis deflection (36) system of the monitor. Under the action of the function switch, the signal can be displayed dynamically or statically or the speed of scanning can be varied. The timing alarm signal for one hour counterpulsation is sent to timed alarm (36) by CPU (22), to give visual and siren alarm.

CPU (22) sends blank signals while PIO (28) sends synchronous signals to the monitoring device (39). The monitoring device consists of the power amplifying circuit of the X, Y deflation system (35) (36), synchronous circuit (40) and blanking signal amplifying circuit (41), high voltage circuit and CRT (not shown). Under the control of the main circuit, the monitor displays synchronously double-track three signals (ECG signal, inflation-deflation signal, pulse wave signal) or double track two signals (ECG signals and inflation-deflation signals), and possesses the ability of freezing images.

Figure 6:
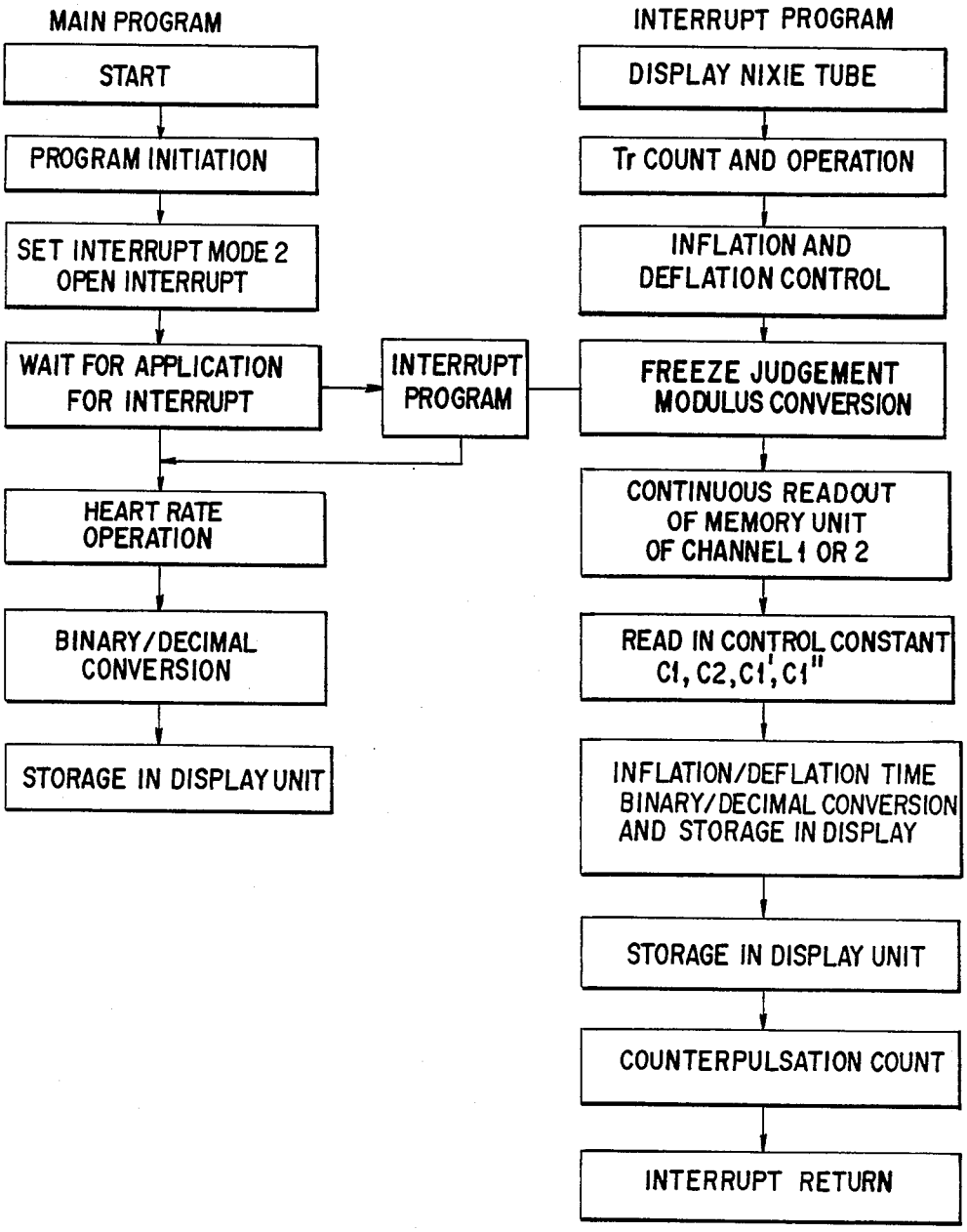
FIG. 6 shows a flow chart of the program.

The main functions of the electric circuit of the combination device, such as ECG digital filtration QRS wave-group detection, pulse rate calculation, inflation-deflation timing calculation, protection of automatic deflation, functioning of double track signals and image freezing and time-based scanning serrated wave are all performed by software. FIG. 6 illustrates the flow chart of the combination device.

Once power is on, the system goes to zero suppression automatically, and executes initial program, sets A port of PIO in the position of control and B port in the state of output. 2000–203F in 2K ROM is the data area of the system which stores time variable parameters of the system, such as pulse rate and the time of beginning of inflation and deflation. 2047–27FF stores digital signals of two channels. After initialization of the computer, through A/D of ADC, the digital signals of ECG undergo a two-point-point-smoothing process, thence through digital filtration, 50 HZ disturb signals are taken off. Then through QRS wave group discrimination program, detect QRS wave group; through pulse-rate subroutine calculate pulse rate, and through inflation-deflation subroutine compute inflation-deflation timing interval. When the interruption of timed 10 ms, as produced by CTC, happens, execute the digital display subroutine.

When interpointer of signal display add 1, the data in the storage area alternate incessantly. Read the data in channel 1 ($CH_1$) first, thereafter read the data in channel 2 ($CH_2$), and read out alternatively the two interleaved channels. Due to incessant change of the data in the storage area, dynamic signals are displayed on the screen, with each displaying for 10 ms of which 5 ms for read out the data, and 5 ms for changing the data. When the image is being frozen in place locked, new data stop to enter the storage area. Then the original data are repeatedly read out in the storage area for resident displaying.

In the software of the system, the suitable time for the beginning of inflation $T_1$ ranges from 10 to 850 ms, while the time for the beginning of deflation $T_2$ ranges from 5 to 800 ms. The range can be increased by a revision of the software.

Figure 7:
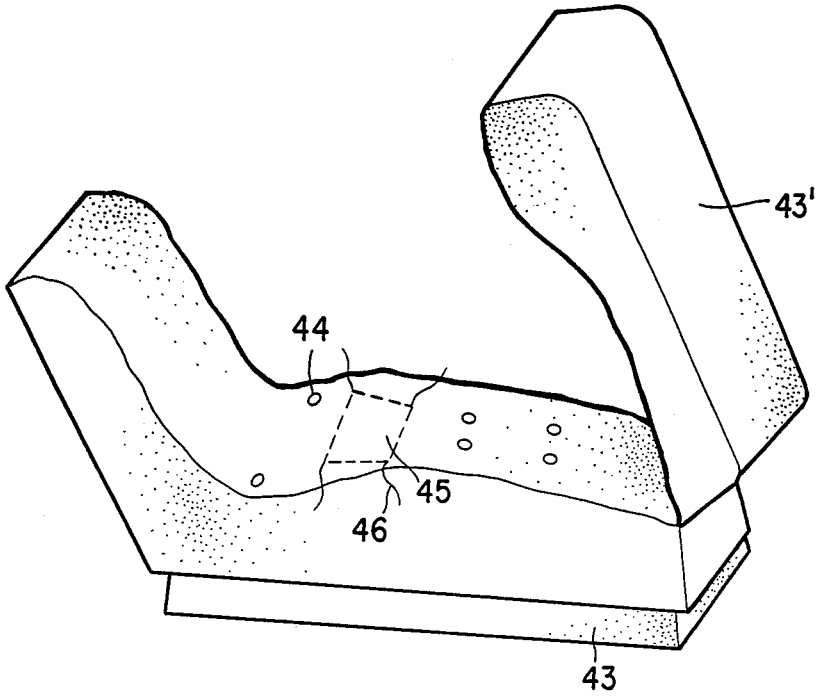
FIG. 7 is a diagram of a special counter-pulsation bed.

Although a patient may lie on an ordinary bed for treatment, yet it is far better to utilize the special counterpulsation bed in question for the patient in using this combination device. The special counterpulsation bed, as shown in FIG. 7, is designed in accordance with the physiological curvature of the human body with respects to its concave and convex surfaces. The end of the bed can be raised or lowered, and a noise muffler (43) is placed underneath the bed, the gas distribution box (4) being under its cover. Another noise muffler (43') which can rotate through an angle of 220° and be detached if not desired, is placed at the end of the bed. Holes (44) are made in the bed for passage of pipes that connect inflation solenoid valves to their respective balloons. When the bed is used for a patient with cardiac arrest, it is better to place a specially-made supporting board (45) on the bed, to facilitate the patient lying on his back. Four tapes (46) are attached to four corners of the supporting board to secure the hard cardiac massage apparatus to a suitable position, so that the massage head can be accurately placed over the lower end of the sternum as shown in FIG. 2*a*. It is also possible to use the soft massage apparatus with massage head as shown in FIG. 2*b*, or to use the soft massage apparatus without massage head, yet with poor results. For use on a counterpulsating patient, the supporting board (45) on the counterpulsation bed may be taken away, while the soft massage apparatus without massage head as shown in FIG. 3*c* should be used.

Figure 8:
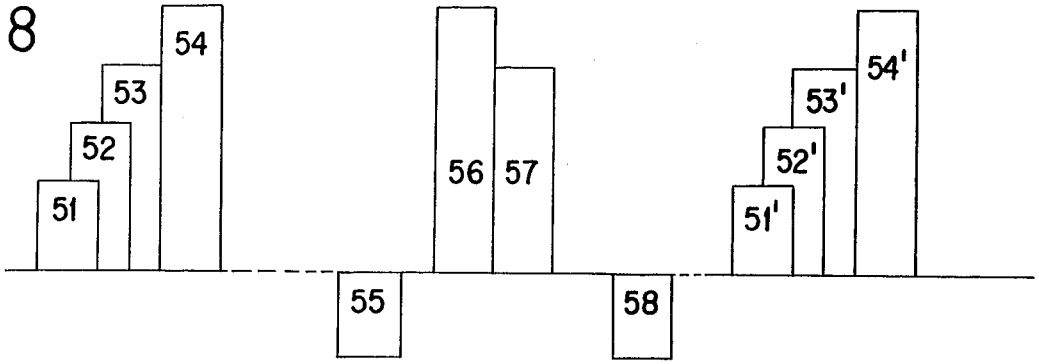
FIG. 8 is a diagram of the controlled sequence of the pulse used for the cardiac-arrest patient.

FIG. 8 represents the controlled-pulse time sequence of the combination device of the present invention used with a patient with cardiac arrest. Under the control of the microcomputer, pulse signals are generated with a frequency of 30 to 80 times per minute to control sequentially the inflation and deflation of the balloons, through trigger 8D to deliver control pulse in sequence, and through power amplification to drive respective solenoid valves, thence the balloons in strict accordance with the set sequence and time, undergo inflation and deflation.

In FIG. 8, the square waves above the base line represent the pulses for inflation, while those below the base line represent the pulses for deflation. The width of square wave represents the time interval for opening either inflation solenoid valves or deflation solenoid valves, and each space along the abscissa represents 40 ms. Square wave (51) respresents opening of solenoid valve (5*a*) which renders inflation of leg balloon (9*a*) and upper-limb balloons (9*a*'). Square wave (52) represents opening of solenoid valve (5*b*) which renders inflation of thigh balloons, square wave (53) represents opening of solenoid valve (5*c*) which renders inflation of lower abdomen buttock balloons (9*c*). Square wave (54) represents opening of solenoid valve (5*d*) which renders inflation of the chest balloon (9*d*). Square wave (55) represents simultaneous opening of 4 sets of deflating solenoid valves 10*a*, 10*b*, 10*c*, 10*d* which render simultaneous deflation of 5 sets of balloons. The time interval of square waves (54) and (55) can be adjusted in the range of 50 to 150 ms. Square wave 56 represents reopening of solenoid valve (5*d*) which renders inflation of the chest balloon (9*d*) inserted in the massage apparatus. Square wave (57) represents reopening of solenoid valve which renders inflation of lower abdomen-buttock balloon. Square wave (58) represents simultaneous deflation of the chest balloon (9*d*) and the lower adbomen-buttock balloon. In this way, the process of massage cycle is completed. The cycle may be repeated or varied according to the change of the time interval between square waves (55) and (56) as well as between square wave (58) and the first square wave (51') in the next cycle. Its range is 30 to 80 times per minute. The number of repetitions can be set according to need.

Figure 9:
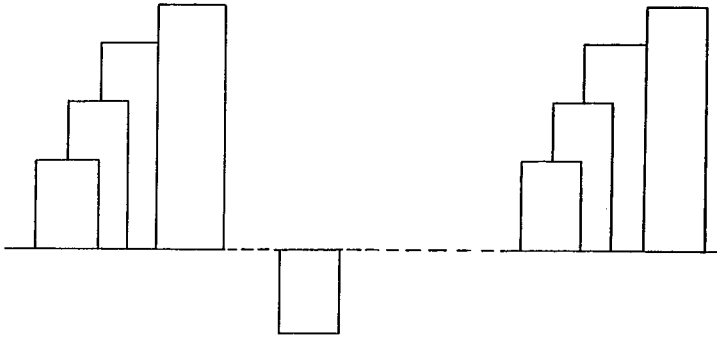
FIG. 9 is a diagram of the controlled sequence of the pulse used for the patient with organ ischemia.

FIG. 9 represents the controlled-pulse sequence of the combination device of the present invention used for a patient with heart beat. The device detects patient's ECG, under the control of the microcomputer through trigger 8D, the QRS wave trigger conrolled pulse in sequence as shown in FIG. 7, through power amplification to drive respective solenoid valves rendering inflation and deflation of the balloons in strict accordance with the set sequence and the time. A comparison between FIG. 7 and FIG. 6 shows that the massage cycle includes only the sequential inflation and simultaneous deflation of the leg balloons (9*a*) and the upper-limb balloons (9*a*'), the thigh balloons (9*b*), the lower-abdomen-buttock balloons (9*c*) as well as the chest balloon (9*d*).

When the above-mentioned combination device is used in counterpulsating a patient with ischemic organ, the pipes (8*a*) will connect the first set of inflation solenoid valve (5*a*) and deflation solenoid valve (10*a*)to the leg balloons (9*a*) and upper-limb balloons (9*a*'). As an alternative, the upper-limb balloons (9*a*') can be taken away while not in use, the inflation (5*a*) and deflation solenoid valves (10*a*) connect solely to the leg balloons, or the chest balloons (9*d*) may be taken away, or the chest balloon (9*d*) and the upper-limb balloons can be taken away together. Yet the use of the chest balloon (9*d*) will give the better result.

The clinical and experimental data have shown that when performing counterpulsation and extrathoracic cardiac massage, the time interval for sequential into inflation of each set of balloons is best set at 40 to 120 ms, the time duration for inflating balloons is 75 to 120 ms. The positive pressure gas from the gas reservoir in passing through the solenoid valves and entering into the balloons for inflation results in a variation in pressure, since the size of each set of balloons is different while the time of inflation is the same. The pressure in the leg balloon (9a) is approximately 250 to 300 mmHg, the pressure in the thigh balloons (9b) is approximately 220 to 270 mmHg, and the pressure in the lower abdomen-buttock balloons is approximately 200 to 250 mmHg. The deflation time lasts for 100 to 120 ms.

The adoption of the above-mentioned method of sequential inflation and decreasing pressure grading will drive a sufficient amount of blood in the lower part of the body back to the trunk, thus diastolic pressure will be augmented conspicously, to render most patients D/S (pulse wave diastolic amplitude/systolic amplitude)≧1.2, and even to reach 2 to 4 for some of them. In patients with sudden cardiac arrest, when the blood is returning to the arch of the aorta, an inflation pressure of 0.35 to 0.5 $Kg/cm^2$ is required to inflate the chest balloon (9d) of the extra thoracic cardiac massage apparatus to cause a cause a downward movement of 2.5 to 5 cm of the massage head (16), and to exert a pressure of 35 to 50 Kg over the lower portion of the sternum, in order to produce a "heart stroke" with a stroke volume of 40 to 100 cc.

When the combination device of the present invention is used as an external counterpulsation for clinical treatment of patients with coronary heart disease and angina pectoris, the symptoms after external counterpulsation have been relieved in most patients with a rate of effectiveness of 90.3%. Furthermore conspicuous effects have been seen in patients with ischemic diseases of the brain, the retina, the kidney and the peripheral vessels. The results will be much better, if at the time of external counterpulsation, an intravenous dripping of thrombolytic drugs is used. The chance of resuscitating a patient with sudden cardiac arrest is greater in using this combination device than ordinary extrathoracic cardiac massage apparatus.

Obviously, many modifications and variations of the present invention are possible in the light of the above teaching.

It is therefore to be understood that within the scope of the appended claims, this invention may be practiced otherwise than as specifically described.

We claim:

1. Apparatus for external counterpulsation and extrathoracic cardiac massage comprising, in combination:

(a) an ECG amplifier;

(b) a pulse wave amplifier;

(c) a monitor;

(d) computer means connected to each of said amplifiers and operative in response to a signal to control a timing control means and the operating mode of said monitor in providing inflation/deflation control signals;

(e) timing control means for controlling distribution of a fluid from a source for inflation and deflation of a plurality of balloons place juxtaposed regions of the human body, said balloons including (1) sets of balloons including two balloons placed symmetrically on the limbs including both the upper and lower limbs, thighs and lower abdomen-buttock regions, and (2) a chest balloon, said chest balloon being housed in an opening of a casing made of soft material and formed as a cuff to be wrapped about the body;

(f) fluid distribution means for inflating said balloons including (1) a reservoir providing said source of fluid, (2) fluid line means including a number of individual fluid lines connecting with said reservoir and individual ones of said balloon and sets of balloons, (3) a pump for pumping fluid from said reservoir into said fluid line means, and (4) a first solenoid valve for control of each individual fluid line whereby during counterpulsation and extrathoracic cardiac massage each of said limb, thigh and lower abdomen-buttock balloons are sequentially inflated, followed by inflation of said client balloon to increase blood returning to the heart;

(5) a second solenoid valve for control of each individual fluid line for substantially simultaneous deflation of said balloon and sets of balloons after inflation, and (6) a counterpulsation bed for the individual undergoing treatment.

2. The apparatus according to claim 1 wherein said timing control circuit operates according to the formula $$T_1 = \tfrac{1}{4}T_r - C_1 + C_1 \ (300\ \text{ms} \leqq T \leqq 850\ \text{ms})\ 1/5.2$$
$$T_r - C'_1 + C_1 \ (850\ \text{ms} < T \leqq 1250\ \text{ms})$$

and the formula $$T_2 = T_r - T_1 - C_2$$

respectively, to initiate inflation in four sequential steps, and, then, control said second solenoid valves to simultaneously carry out deflation.

3. The combination device according to claim 1, wherein said extrathoracic cardiac massage apparatus to house the chest balloon further includes a push board tightly placed underneath and a massage head fixed to the center of the push board bottom and both are wrapped within the bag.

4. The combination device according to claim 1, wherein said chest balloon when lying flat has a surface area of 100–300 cm on one side.

5. The combination device according to claim 4, wherein said chest balloon when inflated has an internal pressure of 0.35–0.50 $kg/cm^2$.

6. The combination device according to claim 1, wherein said counterpulsation bed is one specially made for counterpulsation and is designed in accordance with the normal physiological curvature of the body with respects to its concave and convex surface. The head of the bed can be raised and lowered, detachable supporting board is placed on the bed relative to the position of the back of a patient when lying down, and to each of the four corners of the board a tape is attached to fasten the hard massage apparatus which is to be placed right to the position of the lower end of patient's sternum.

7. The combination device according to claim 6, wherein said counterpulsation bed has holes for the passage of pipes that connect inflation-deflation solenoid valves to their respective balloons.

8. The combination device according to claim 6 or 7, wherein said special counterpulsation bed is equipped with noise muffling hood.

* * * * *